US011480129B2

(12) United States Patent
Hill

(10) Patent No.: US 11,480,129 B2
(45) Date of Patent: Oct. 25, 2022

(54) FUEL SYSTEM AND FUEL INJECTOR CONTROL STRATEGY FOR STABILIZED INJECTION CONTROL VALVE CLOSING

(71) Applicant: Caterpillar Inc., Peoria, IL (US)

(72) Inventor: Adam Charles Hill, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/180,185

(22) Filed: Feb. 19, 2021

(65) Prior Publication Data

US 2022/0268234 A1 Aug. 25, 2022

(51) Int. Cl.

*F02D 41/40* (2006.01)
*F02M 51/06* (2006.01)
*F02D 41/20* (2006.01)

(52) U.S. Cl.

CPC ..... *F02D 41/401* (2013.01); *F02M 51/061* (2013.01); *F02D 2041/2037* (2013.01); *F02D 2041/2055* (2013.01)

(58) Field of Classification Search

CPC ..... F02D 2041/2055; F02D 41/401; F02D 2041/2037; F02M 51/061

See application file for complete search history.

(56) References Cited

U.S. PATENT DOCUMENTS 5,788,154 A * 8/1998 Beatty ..... F02M 57/025 239/124
5,839,412 A * 11/1998 Stockner ..... F02M 59/466 123/446
5,975,053 A * 11/1999 Rodier ..... F02D 41/20 123/446
6,116,209 A 9/2000 Christ et al.
RE37,807 E * 7/2002 Shinogle ..... F02M 59/366 123/480
6,874,703 B2 4/2005 Gottemoller et al.
7,013,876 B1 * 3/2006 Puckett ..... F02D 41/20 123/490
8,055,460 B2 * 11/2011 Rajagopalan ..... G01R 31/2829 702/65
8,316,826 B2 11/2012 Coldren et al.
9,376,982 B2 * 6/2016 Itaya ..... F02D 41/40
(Continued)

FOREIGN PATENT DOCUMENTS

DE 102016203191 A1 8/2017
GB 2312714 B 8/1999
GB 2552516 B 4/2020

OTHER PUBLICATIONS

Written Opinion and International Search Report for Int'l Patent Appln. No PCT/US2022/013088, dated May 6, 2022 (13 pgs).

*Primary Examiner* — Carl C Staubach
(74) *Attorney, Agent, or Firm* — Brannon Sowers & Cracraft PC

(57) ABSTRACT

A fuel system includes a fuel injector, and a fueling control unit electrically connected to a solenoid actuator in the fuel injector. The fueling control unit is structured to energize and deenergize the solenoid actuator to lift and return an armature coupled with an injection control valve. The fueling control unit also reenergizes the solenoid actuator with an armature retarding current while the armature is in flight to stabilize closing of the injection control valve. The armature retarding current can be used to electronically trim the fuel injector to limit an error in a quantity of injected fuel.

18 Claims, 4 Drawing Sheets

(56) References Cited

U.S. PATENT DOCUMENTS

| | | | | |
|---|---|---|---|---|
| 9,879,645 | B2 | 1/2018 | Knapp et al. | |
| 9,964,732 | B1 * | 5/2018 | Tabuchi | H02P 6/182 |
| 10,865,727 | B2 * | 12/2020 | Jahn | G05B 15/02 |
| 11,300,068 | B1 * | 4/2022 | Hill | F02M 63/0021 |
| 2012/0216783 | A1 * | 8/2012 | Kusakabe | F02D 41/20 123/490 |
| 2015/0198110 | A1 * | 7/2015 | Puckett | F02D 41/3082 123/478 |
| 2017/0138292 | A1 * | 5/2017 | Schweikert | F02D 41/20 |

* cited by examiner

FUEL SYSTEM AND FUEL INJECTOR CONTROL STRATEGY FOR STABILIZED INJECTION CONTROL VALVE CLOSING

TECHNICAL FIELD

The present disclosure relates generally to limiting errors in fuel injection quantity in a fuel system, and more particularly to retarding an armature in an injection control valve assembly to stabilize closing of an injection control valve.

BACKGROUND

Fuel systems employed in internal combustion engines, and notably compression-ignition engines, are typically complex apparatuses. Fuel system components can be subjected to harsh service conditions including high pressures, rapid pressure changes, and repeated impacts of valve elements and related parts over time. Fuel injectors are employed to inject pressurized fuel at pressures which can be in excess of 200 Megapascals (MPa), and can actuate a number of times ranging into the billions over the course of a typical service life. Engineers have discovered that reliable operation and optimized performance of a fuel system can be critical to achieving goals such as power density, emissions mitigation, and efficiency.

In view of the above goals, systems for monitoring, controlling, and electronically trimming fuel system components such as fuel injectors with great precision have been developed and are widespread throughout the world. It has also been observed that controlling fuel injector operation, for example, through the use of varied pulse width of fuel delivery command signals can be used to operate a fuel injector at different engine conditions as well as compensate for individual injector variation and changes to injector behavior over time. U.S. Pat. No. RE37807E1 to Shinogle is directed to a strategy for electronic trimming. The strategy set forth by Shinogle et al. apparently minimizes or eliminates performance variation of an apparatus such as a fuel injector by deriving trim signals from observed performance parameter values taken at a plurality of operating conditions. While electronic trimming strategies such as that proposed by Shinogle et al., and still others, can assist in optimizing performance, there remains ample room for improvement and development of alternative strategies. For instance, there are some scenarios where conventional electronic trimming and other control strategies are insufficient to account for certain mechanical and hydraulic phenomena that can be observed, at least at times, that cause errors in a quantity of injected fuel.

SUMMARY OF THE INVENTION

In one aspect, a fuel system for an engine includes a fuel injector having formed therein a high pressure fuel inlet and a control chamber, and defining a low pressure space. The fuel injector has an outlet check having a closing hydraulic surface exposed to a fluid pressure of the control chamber, a solenoid actuator, an armature movable in the fuel injector based on energizing and deenergizing the solenoid actuator, and an injection control valve movable in the fuel injector based on the moving of the armature to open and close a fluid connection between the control chamber and the low pressure space. A fueling control unit is electrically connected to the solenoid actuator and structured to energize the solenoid actuator to lift the armature from a stop position and open the injection control valve to start an injection of fuel from the fuel injector. The fueling control unit is further structured to deenergize the solenoid actuator to initiate returning the armature to the stop position, and reenergize the solenoid actuator with an armature retarding current while the armature is in flight toward the stop position. The fueling control unit is still further structured to stabilize, by way of the armature retarding current, closing of the injection control valve to end the injection of fuel from the fuel injector.

In another aspect, a fuel control system includes a fueling control unit having a data processor, and a computer readable memory. The computer readable memory stores fueling control instructions for actuating a fuel injector to inject fuel into a combustion cylinder in an engine, and a trim file for limiting an error in a quantity of the injected fuel. The data processor is structured by way of executing the fueling control instructions to energize a solenoid actuator in the fuel injector with a pull-in current to lift an armature from a stop position and open an injection control valve to start an injection of fuel from the fuel injector. The data processor is further structured to deenergize the solenoid actuator to initiate returning the armature to the stop position, and reenergize the solenoid actuator with an armature retarding current that is based on the trim file while the armature is in flight toward the stop position. The data processor is still further structured to stabilize, by way of the armature retarding current, closing of the injection control valve to end the injection of fuel from the fuel injector.

In still another aspect, a method of operating a fuel system for an engine includes energizing a solenoid actuator to lift an armature in a fuel injector from a stop position, and opening an injection control valve fluidly between a check control chamber and a low pressure space of the fuel injector, based on the lifting of the armature, to start an injection of fuel from the fuel injector. The method further includes deenergizing the solenoid actuator to initiate returning of the armature to the stop position, reenergizing the solenoid actuator to retard the armature while in flight toward the stop position, and stabilizing, based on the retarding of the armature, closing of the injection control valve to end the injection of fuel.

DETAILED DESCRIPTION

Figure 1:
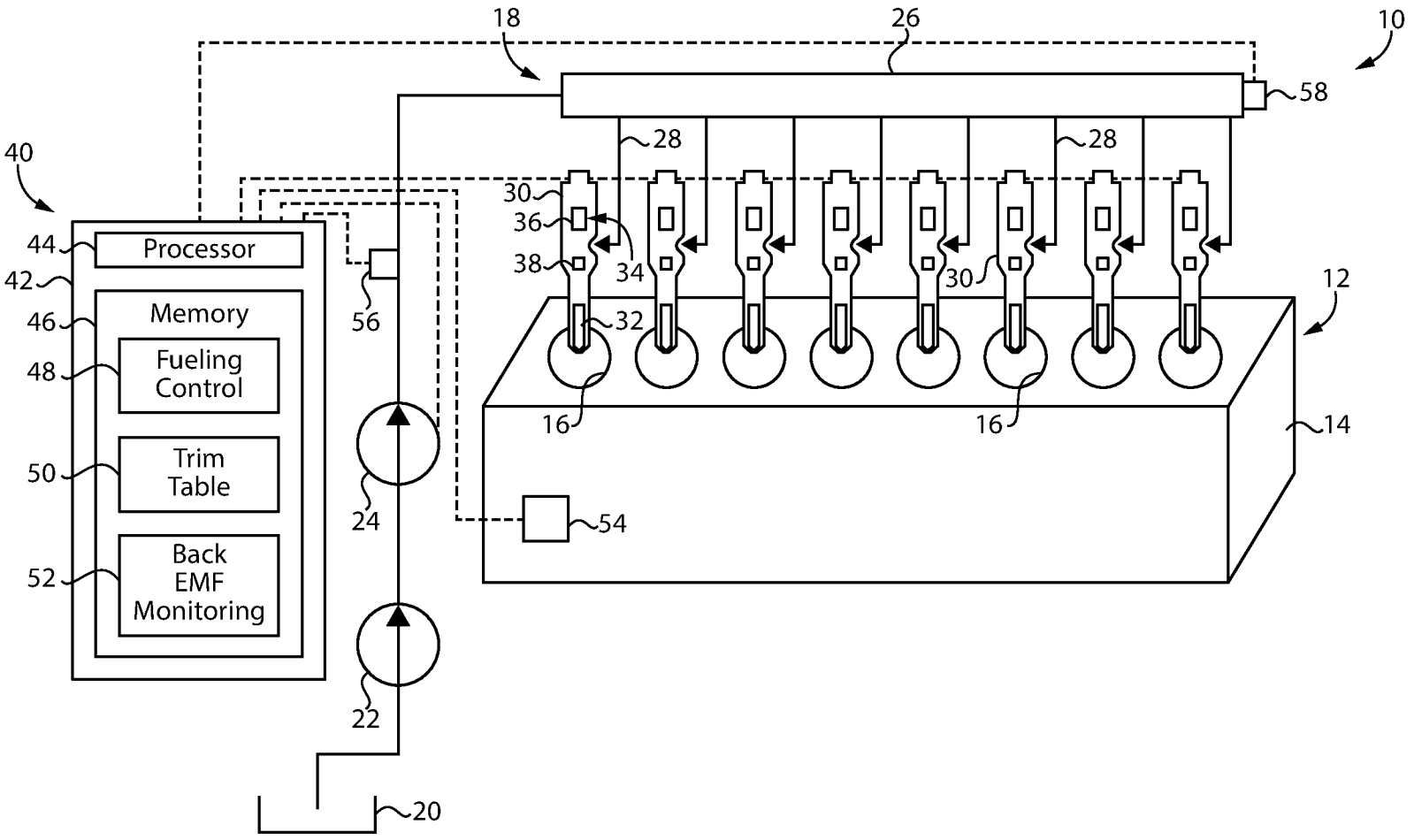
FIG. 1 is a diagrammatic view of an internal combustion engine system, according to one embodiment.

Referring to FIG. 1, there is shown an internal combustion engine system 10, according to one embodiment. Engine system 10 includes an internal combustion engine 12 having an engine housing 14 with a plurality of combustion cylinders 16 formed therein. Engine 12 may be a compression-ignition engine such as a diesel engine operable on a liquid diesel distillate fuel. Engine 12 could alternatively be a spark-ignited liquid fuel engine, or a dual fuel engine, for example. Combustion cylinders 16 are shown in an inline pattern but could alternatively be in a V-pattern or any other suitable arrangement. Pistons (not shown) are positioned in combustion cylinders 16 and typically movable in a conventional four stroke engine cycle to rotate a crankshaft for propelling a vehicle, operating a pump, a compressor, or other equipment, or for rotating a generator to produce electrical power, to name a few examples. Engine system 10 will typically be equipped with an intake air system, an exhaust system having exhaust aftertreatment components, and one or more turbochargers, as well as an engine head supporting fuel injectors 30, valve covers, and various other components not specifically illustrated.

Engine system 10 further includes a fuel system 18. Fuel system 18 includes a fuel tank 20, a transfer pump 22, a high pressure pump 24, and a pressurized fuel reservoir such as a common rail 26. A plurality of feed lines 28 extend from common rail 26 to a plurality of fuel injectors 30 each positioned for direct injection of a pressurized liquid fuel from common rail 26 into one of combustion cylinders 16. In other embodiments, fuel injectors 30 might each be associated with a unit pump, dedicated to that fuel injector or shared with one or more other fuel injectors. Each of fuel injectors 30 includes a directly controlled outlet check 32, and an injection control valve assembly 34 having a solenoid actuator 36 and an injection control valve 38, as well as other components and features further discussed herein.

Engine system 10 further includes a fuel control system 40 having a fueling control unit 42 electrically connected to each of solenoid actuators 36. Fueling control unit 42 includes a data processor 44, and a computer readable memory 46. Data processor 44 may be any suitable computerized processor having a central processing unit, such as a microprocessor or a microcontroller. Description and discussion herein of fueling control unit 42 or parts thereof should not be taken to require any number, type, arrangement, allocation of functions, or any other limitation in particular with respect to system components or architecture. Fueling control unit 42 could be a fuel system control unit dedicated for fuel system operation, or a part of a control unit having various other functions, for instance. Computer readable memory 46 could include any suitable computer readable memory such as RAM, ROM, EEPROM, DRAM, SDRAM, flash, a hard drive, or still another.

Computer readable memory 46 stores fueling control instructions 48 for actuating each of fuel injectors 30 to inject fuel into one of combustion cylinders 16 in engine 12, and a trim table 50 including a plurality of trim files for limiting an error in a quantity of injected fuel. Computer readable memory 46 may also store back electro-motive force (EMF) monitoring instructions 52. In some embodiments, fueling control unit 42 may be structured for in-chassis determining and populating of trim table 50, and in this regard can execute back EMF monitoring instructions 52 for purposes further discussed herein. In other instances, trim table 50 may be populated during fuel injector testing and calibration during engine manufacturing and build, or some combination of populating trim table 50 in-chassis and during manufacturing might be used. Trim table 50 might also include trim files downloaded from a server and potentially updated periodically, or read computer readable memory or otherwise machine readable codes resident on fuel injectors 30. Fuel control system 40 may further include a pressure sensor 58 structured to monitor a fuel pressure in common rail 26, an engine speed sensor 54 structured to monitor an engine speed, and a temperature sensor 56 structured to monitor a temperature such as a fuel temperature, an engine temperature, or any other temperature for control purposes that will be further apparent by way of the following description. Fueling control unit 42 is electrically connected to each solenoid actuator 36 as noted above and may also be electrically connected to, or otherwise in communication with, the various sensors in fuel control system 40, and to high pressure pump 24.

Figure 2:
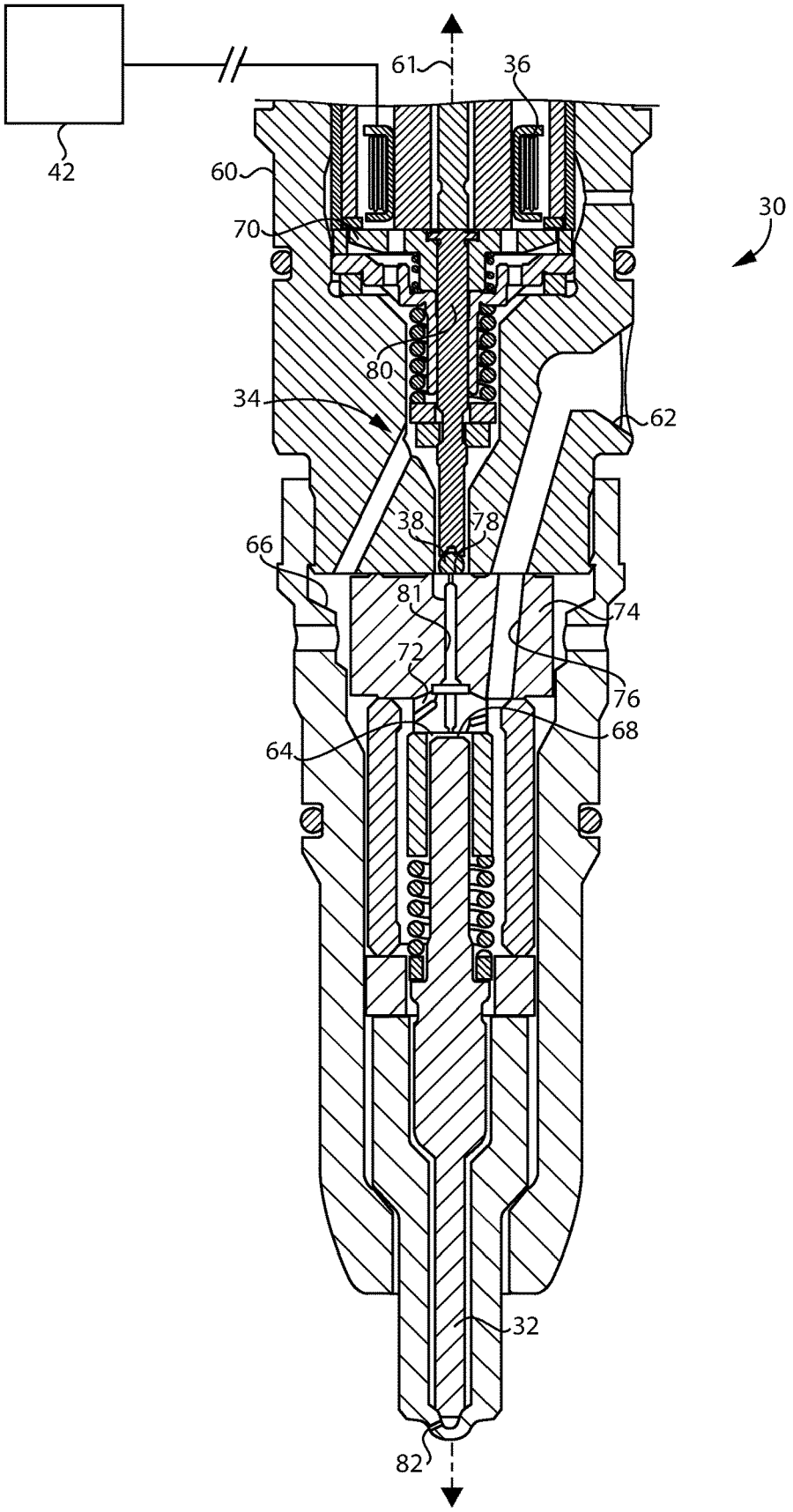
FIG. 2 is a sectioned side diagrammatic view of a fuel injector, according to on embodiment.
Figure 3:
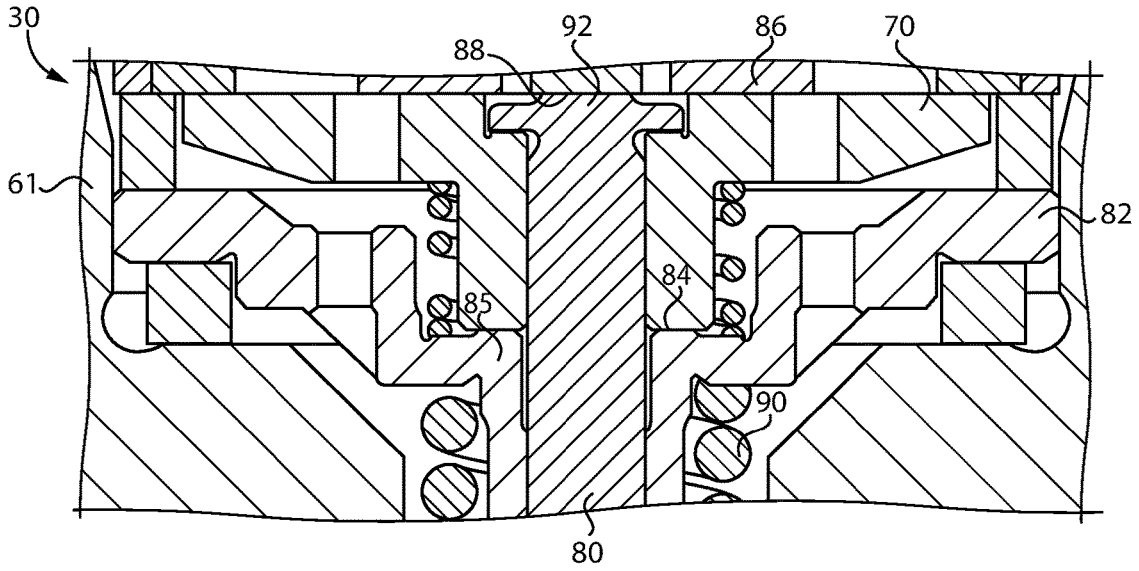
FIG. 3 is an enlarged view of a portion of the fuel injector of FIG. 2.

Referring also now to FIGS. 2 and 3, there are shown features of one of fuel injectors 30 in further detail. Each fuel injector 30, hereinafter referred to at times in the singular, includes an injector housing 60 defining a longitudinal axis 61. A plurality of nozzle outlets 82 are formed in injector housing 60 and are opened and closed by way of outlet check 32. Fuel injector 30 has formed therein a high pressure fuel inlet 62 and a control chamber 64, and defines a low pressure space 66. High pressure fuel inlet 62 may be structured to couple with one of feed lines 28 to receive a flow of pressurized fuel at an injection pressure. A nozzle supply passage 76 extends between high pressure fuel inlet 62 and nozzle outlets 82. Outlet check 32 has a closing hydraulic surface 68 exposed to a fluid pressure of control chamber 64. Low pressure space 66 can be a space within injector housing 60, or outside of injector housing 60, that provides a pressure lower than a fuel pressure of fuel supplied at high pressure inlet 62.

As also noted above, fuel injector 30 includes an injection control valve assembly 34. Injection control valve assembly 34 includes a solenoid actuator 36 having a solenoid coil (not separately numbered), and an armature 70. Armature 70 is movable in fuel injector 30 based on energizing and deenergizing solenoid actuator 36. Injection control valve 38 is movable in fuel injector 30 based on the moving of armature 70 to open and close a fluid connection between control chamber 64 and low pressure space 66. In the illustrated embodiment injection control valve 38 includes a ball valve, which may be a flat-sided ball valve. Injection control valve 38 is movable between a closed position, as depicted in FIG. 2, and an open position, fluidly connecting control chamber 64 to low pressure space 66 by way of a drain passage or drain orifice 81. Injection control valve 38 contacts a valve seat 78, which may be a flat valve seat, to block fluid connection between control chamber 64 and low pressure space 66, and lifts from contact with valve seat 78 to establish such fluid connection. The opening and closing of injection control valve 38 can relieve and restore fluid pressure in control chamber 64 acting on closing hydraulic surface 68 in a manner that will be familiar to those skilled in the art. Control chamber 64 is fluidly connected by way of one or more fill orifices to nozzle supply passage 76, also in a manner that will be familiar to those skilled in the art.

In the illustrated embodiment, injection control valve assembly 34 further includes a valve rod 80 that is unattached to injection control valve 38 and coupled with armature 70. Injection control valve 38 is held captive between valve rod 80 and valve seat 78. When solenoid actuator 36 is energized with an electrical current, armature 70 is drawn magnetically toward solenoid actuator 36. When solenoid actuator 36 is deenergized, partly or totally deenergized, armature 70 may move away from solenoid actuator 36. As can be seen from FIG. 3, when solenoid actuator 36 is deenergized armature 70 rests at a first stop position against a first stop 84. When solenoid actuator 36 is energized armature 70 moves from the first stop position in contact with stop 84 toward a second stop position where valve rod 80 contacts a second stop 88. Stop 84 may be formed by a surface of an armature housing 85. Armature housing 85 may be fixed in position within injector housing 61 by clamping between adjacent components, for example. Stop 88 may be formed by an actuator housing 86. Stops could be formed by other components in other embodiments. It can also be seen from FIGS. 2 and 3 that a biasing spring 90 is coupled between armature housing 85 and valve rod 80. Biasing spring 90 may be compressed when armature 70 lifts from its first stop position and can bias both valve rod 80 and armature 70 toward the first stop position in opposition to magnetic attraction forces produced when solenoid actuator 36 is energized. Armature 70 and valve rod 80 may be unattached, with valve rod 80 having a radially projecting flange or the like 92 that is lifted by armature 70 when armature 70 lifts from its first stop position. It will thus be appreciated that injection control valve 38, valve rod 80, and armature 70 may not be rigidly, fixedly attached to one another, but instead provide some tolerance for very small clearances to be opened and closed between the respective parts during operation. It has been observed that armature bouncing can occur when armature 70 returns to its first stop position when solenoid actuator 36 is deenergized. Injection control valve 38 can also experience bouncing, between valve rod 80 and valve seat 78, formed in a valve seat plate 74 in the illustrated embodiment. Bouncing of injection control valve 38, or failed, incomplete, delayed, or otherwise unstable closing of injection control valve 38, can influence the timing, manner, and precision of restoring a closing hydraulic pressure to control chamber 72. It is believed that instability in closing of an injection control valve, in response to armature bouncing, can contribute to errors in a quantity of fuel injected by a fuel injector relative to a quantity intended to be injected. The present disclosure provides strategies for limiting errors in a quantity of injected fuel, by stabilizing closing of injection control valve 38. Stabilizing closing of injection control valve 38 is believed to more reliably end an injection of fuel from fuel injector 30, as further discussed herein.

To this end, fueling control unit 42 is structured, by way of executing fueling control instructions 48, to energize solenoid actuator 36 with a pull-in current to lift armature 70 from its first stop position and open injection control valve 38 to start an injection of fuel from fuel injector 30. Fueling control unit 42 and data processor 44 are referred to herein interchangeably, at times, with regard to functionality and structure, and thus the description of logic functions and execution of instructions by fueling control unit 42 should be understood to refer also generally to data processor 44. Fueling control unit 42 is further structured, by way of executing fueling control instructions 48, to deenergize solenoid actuator 36 to initiate returning armature 70 to the first stop position. It will be recalled that armature 70 can be understood to have a first stop position in contact with stop 84, and a second stop position where valve rod 80 contacts stop 88. Accordingly, when solenoid actuator 36 is energized with a pull-in current armature 70 lifts from contact with stop 84 and travels, axially in fuel injector 30, until valve rod 80 contacts stop 88. In some embodiments energizing solenoid actuator 36 in the manner described includes energizing solenoid actuator 36 with a subsequent hold current to hold armature in a lifted position with valve rod 80 against stop 88, having a magnitude less than a magnitude of the pull-in current. Fueling control unit 42 is further structured to deenergize solenoid actuator 36 to initiate returning armature 70 to the first stop position. It will also be recalled that armature 70 returns towards the first stop position in contact with stop 84 under the influence of a bias of biasing spring 90. Fueling control unit 42 is further structured, by way of executing fueling control instructions 48, to reenergize solenoid actuator 36 with an armature retarding current, which may be based on a stored trim file in trim table 50, while armature 70 is in flight toward the first stop position. Fueling control unit 42 is further structured to stabilize, by way of the armature retarding current, closing of injection control valve 38 to end the injection of fuel from fuel injector 30.

Figure 4:
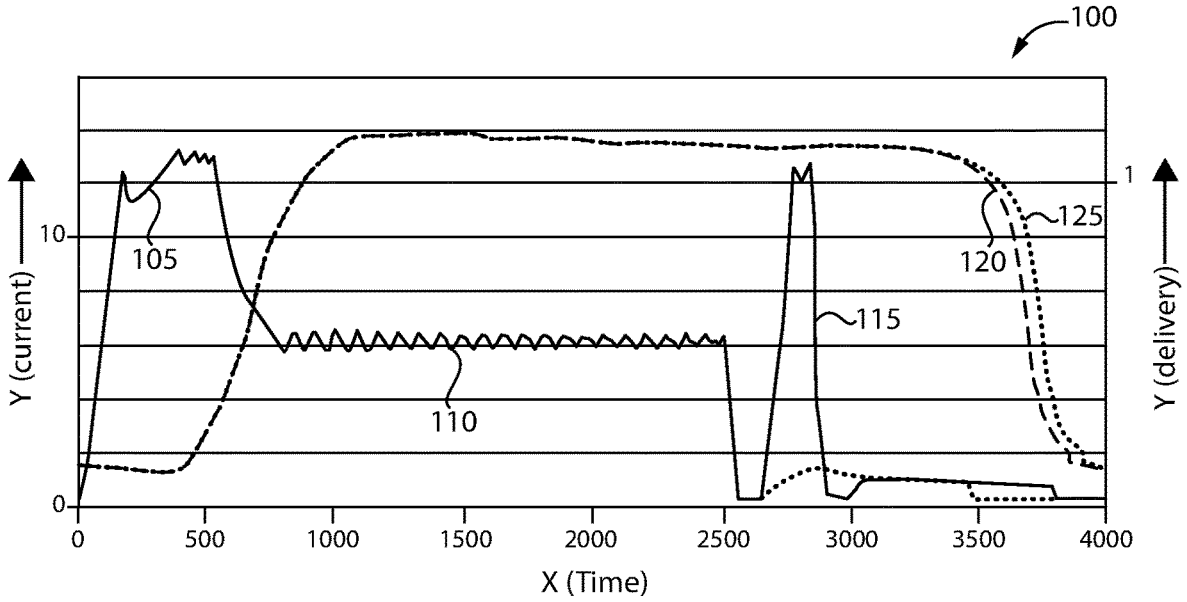
FIG. 4 is a graph of fuel injection events, according to one embodiment.
Figure 5:
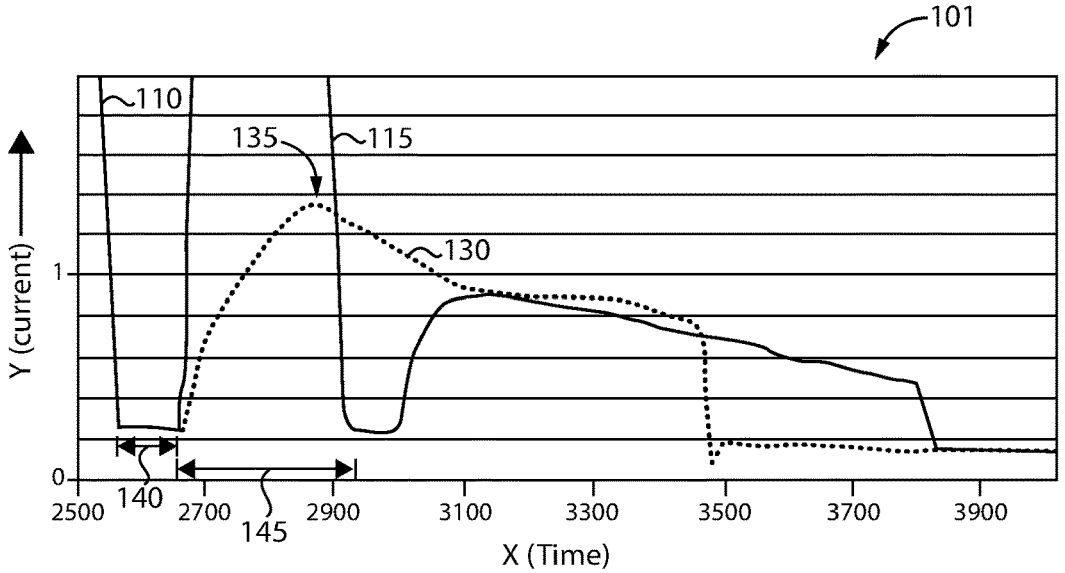
FIG. 5 is a graph showing an enlarged portion of the graph of FIG. 4.

Referring also now to FIG. 4, there is shown a graph 100 illustrating fuel injector events and operational properties. A pull-in current is shown at 105 and is a relatively higher magnitude current that initiates lifting of armature 70. A hold current is shown at 110 and has a magnitude less than a magnitude of the pull-in current. The armature retarding current is shown at 115. It will be appreciated that solenoid actuator 36 is energized beginning at about a time t=0, with pull-in current 105, then continues to be energized with hold current 110 until about a time t=2500, after which solenoid actuator 36 is deenergized, and then reenergized with the armature retarding current 115. Hold current 110 has a magnitude less than a magnitude of pull-in current 105, as less energy may typically be required to hold armature 70 lifted with valve rod 80 in contact with stop 88 than what is necessary to rapidly and reliably initiate armature lifting. It can also be noted that armature retarding current 115 has a magnitude greater than a magnitude of hold current 110, and a duration less than a duration of hold current 110. Referring also now to FIG. 5, there is depicted a dwell time 140 between hold current 110 and armature retarding current 115. A duration 145 of armature retarding current 115 is also shown. In one implementation, at least one of dwell time 140 or duration 145 is based on a stored trim file in trim table 50, and can be varied to electronically trim fuel injector 30. Electronically trimming fuel injector 30 can include producing an armature retarding current in a present engine cycle that is varied relative to a prior armature retarding current in a prior engine cycle Electronic trimming may employ varied pulse width, or sometimes other pulse properties, in a fuel injector electrical actuator to vary operation of the fuel injector to achieve some desired aim, typically metering the fuel so as to provide a desired injection quantity. Fuel injectors can vary in performance one to another based on factors such as manufacturing tolerances. Fuel injectors can also vary in operation over time due to wear, deformation of components, or for other reasons. Fuel injectors can also vary in operation at different engine states, including different engine temperatures, different fuel temperatures, different cylinder pressures, or for various other reasons. The present disclosure contemplates receiving, with data processor 44, engine state data. The engine state data may be associated with a closing timing of injection control valve 38. For instance, fuel may have a varied viscosity at different temperatures, potentially affecting the tendency of armature 70 to bounce or the manner by which armature 70 bounces. At higher temperatures armature bouncing may be more pronounced, and at lower temperatures less pronounced or not observed at all. Accordingly, one example of engine state data that might be received by data processor 44 is fuel temperature data. Another example of engine state data includes engine or fuel injector aging state data, for instance service hours or some other direct or indirect measure of aging state. Based on the different armature bouncing likelihood, or properties of bouncing, injection control valve 38 can also vary with respect to valve bouncing or other forms of closing instability at different engine states. Another way to understand this relationship is that a valve closing timing, or an expected valve closing timing, of injection control valve, can vary based on engine state. The use of electronic trim files in trim table 50 can enable fueling control unit 42 to compensate for such variation, and in the example suggested above by varying at least one of dwell time 140 or duration 145 of armature retarding current 115 by way of electronic trimming.

FIG. 5 also illustrates a trace 130 corresponding to armature position generally, based on a back electromotive force (EMF) induced by armature 70 in an actuator control circuit, such as a control circuit resident on fueling control unit 42. Trace 130 shows a peak at or near a numeral 135. Near numeral 135 back EMF has reached a local maximum which has been demonstrated to be indicative of an armature reaching or nearing a stop position. In other words, at or near peak 135 armature 70 contacts stop 84. As suggested above, by limiting armature bouncing against stop 84, injection control valve bouncing, or other instability, can be reduced and closing stabilized. As explained above, fueling control unit 42 could electronically trim fuel injector 30 by populating trim files in-chassis. Thus, monitoring back EMF may be used during service to detect a closing timing, or a change in an expected closing timing, of injection control valve 38, and update stored trim files. This could include running a diagnostic-based execution of back EMF monitoring instructions 52. In still other embodiments, back EMF could be monitored continuously or periodically and fuel injector 30 trimmed by adjusting a dwell time associated with armature retarding current 115 or a duration thereof. The present disclosure is not limited in regards to where, when, or how a trim file used to electronically trim a fuel injector in the manner described herein is obtained.

FIG. 4 also illustrates an injection rate trace at 120, and another injection rate trace at 125. It will be appreciated that rate 125 is shifted in time relative to rate 120. Rate 125 represents what might be observed without the use of an armature retarding current according to the present disclosure, whereas rate 120 is representative of what might be observed according to the present disclosure. Another way to understand the difference between injection rate 125 and injection rate 120 is that a relatively small amount of excess fuel may be injected when the armature retarding current is not being used, resulting from instability in closing of an injection control valve. This can be undesirable from the standpoint of emissions mitigation, controllability, and fuel efficiency, for example. Rather than additional fuel being injected, in some instances injection rate without the use of an armature retarding current might simply be more variable cycle to cycle. In this way the present disclosure limits errors in a quantity of fuel injection from fuel injector 30.

INDUSTRIAL APPLICABILITY

Figure 6:
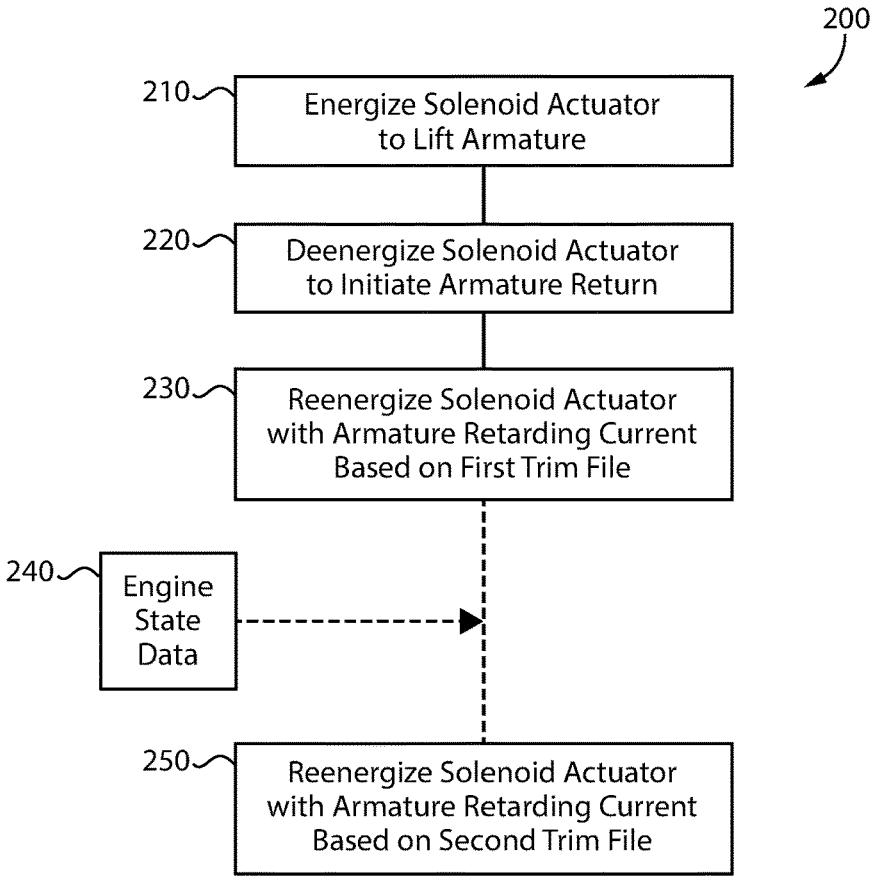
FIG. 6 is a flow chart of example methodology and control logic flow, according to one embodiment.

Referring to the drawings generally, but also now to FIG. 6, there is shown a flowchart 200 illustrating example methodology and control logic flow, according to the present disclosure. Flowchart 100 includes a block 210 where solenoid actuator 36 is energized to lift armature 70 from its first stop position. As discussed herein, lifting armature 70 from a stop position opens injection control valve 38 to start an injection of fuel from fuel injector 30. From block 210 the logic advances to a block 220 to deenergize solenoid actuator 36 to initiate returning of armature 70 to its first stop position. Energizing solenoid actuator 36 can include energizing with a pull-in current and a subsequent hold current as described herein. From block 220 the logic advances to a block 230 to reenergize solenoid actuator 36 with an armature retarding current to retard armature 70 while in flight toward the stop position.

Reenergizing solenoid actuator 36 can be based on a first trim file, and can occur in a first engine cycle or a prior or preceding engine cycle. A first trim file could be a trim file applied to determine a dwell time between a hold current and the armature retarding current, a duration of the armature retarding current, both dwell and duration, a magnitude of the armature retarding current, or still another property. Engine state data is received/inputted at a block 240. From block 230 the logic advances to a block 250 to reenergize solenoid actuator 36 with an armature retarding current that is based on a second trim file different from the first trim file. Block 250 represents a fuel injection event that occurs in a second, or subsequent engine cycle. In some engine states no armature retarding current may be used at all. Between blocks 230 and 250 fueling control unit 42 can be operating to energize and deenergize solenoid actuator 36, analogous to blocks 210-220, but these logic steps are omitted for clarity of illustration. It will thus be appreciated that based upon various changes to engine state different trim files can be applied to vary the armature retarding current in an engine cycle relative to a preceding armature current in a preceding engine cycle.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel system for an engine comprising:

a fuel injector having formed therein a high pressure fuel inlet and a control chamber, and defining a low pressure space;

the fuel injector including an outlet check having a closing hydraulic surface exposed to a fluid pressure of the control chamber, a solenoid actuator, an armature movable in the fuel injector based on energizing and deenergizing the solenoid actuator, and an injection control valve movable in the fuel injector based on the moving of the armature to open and close a fluid connection between the control chamber and the low pressure space;

the injection control valve is captive between a valve seat and a valve rod coupled to the armature and unattached to the injection control valve; and a fueling control unit electrically connected to the solenoid actuator and structured to:

energize the solenoid actuator to lift the armature from a stop position and open the injection control valve to start an injection of fuel from the fuel injector;

deenergize the solenoid actuator to initiate returning the armature to the stop position;

reenergize the solenoid actuator with an armature retarding current while the armature is in flight toward the stop position;

stabilize, by way of the armature retarding current, closing of the injection control valve to end the injection of fuel from the fuel injector;

monitor a back EMF induced by the armature in an actuator control circuit; and vary at least one of a dwell time before the armature retarding current or a duration of the armature retarding current based on a timing of a local maximum of the back EMF that is indicative of the armature reaching the stop position.

2. The fuel system of claim 1 wherein the fueling control unit is further structured to electronically trim the fuel injector with the armature retarding current.

3. The fuel system of claim 1 wherein the fueling control unit is further structured to determine the armature retarding current based on engine state data associated with a closing timing of the injection control valve.

4. The fuel system of claim 3 wherein the engine state data includes temperature data.

5. The fuel system of claim 1 wherein the fueling control unit is further structured to energize the solenoid actuator with a pull-in current to initiate the lift of the armature from a stop position, and with a hold current to hold the armature at a second stop position.

6. The fuel system of claim 5 wherein the armature retarding current has a magnitude greater than a magnitude of the hold current and a duration less than a duration of the hold current.

7. The fuel system of claim 5 wherein at least one of a dwell time between the hold current and the armature retarding current or a duration of the armature retarding current, in a present engine cycle, is varied relative to a prior armature retarding current in a prior engine cycle.

8. The fuel system of claim 1 wherein the fueling control unit is further structured, based on a retarding of the armature with the armature retarding current, to limit bouncing of the armature against an armature stop, and to limit bouncing of the injection control valve between the valve seat and the valve rod based on the limiting of the bouncing of the armature.

9. A fuel control system comprising:

a fueling control unit including a data processor, and a computer readable memory;

the computer readable memory storing fueling control instructions for actuating a fuel injector to inject fuel into a combustion cylinder in an engine, and a trim file for limiting an error in a quantity of the injected fuel;

the data processor is structured by way of executing the fueling control instructions to:

energize a solenoid actuator in the fuel injector with a pull-in current to lift an armature from a stop position and open an injection control valve to start an injection of fuel from the fuel injector;

deenergize the solenoid actuator to initiate returning the armature to the stop position;

reenergize the solenoid actuator with an armature retarding current that is based on the trim file while the armature is in flight toward the stop position; and stabilize, by way of the armature retarding current, closing of the injection control valve to end the injection of fuel from the fuel injector;

the data processor is further structured to:

monitor a back EMF induced by the armature in an actuator control circuit; and vary at least one of a dwell time before the armature retarding current or a duration of the armature retarding current based on a timing of a local maximum of the back EMF that is indicative of the armature reaching the stop position.

10. The fuel control system of claim 9 wherein the data processor is further structured by way of executing the fueling control instructions to energize the solenoid actuator with a hold current having a magnitude less than a magnitude of the pull-in current to hold the armature at a second stop position.

11. The fuel control system of claim 10 wherein the armature retarding current has a magnitude greater than a magnitude of the hold current and a duration less than a duration of the hold current.

12. The fuel control system of claim 10 wherein at least one of a dwell time between the hold current and the armature retarding current or a duration of the armature retarding current is based on the trim file.

13. The fuel control system of claim 9 wherein the data processor is further structured to receive engine state data associated with a closing timing of the injection control valve and, by way of executing the fueling control instructions, electronically trim the fuel injector using the trim file based on the engine state data.

14. A method of operating a fuel system for an engine comprising:

energizing a solenoid actuator to lift an armature in a fuel injector from a stop position;

opening an injection control valve fluidly between a check control chamber and a low pressure space of the fuel injector, based on the lifting of the armature, to start an injection of fuel from the fuel injector;

deenergizing the solenoid actuator to initiate returning of the armature to the stop position;

reenergizing the solenoid actuator to retard the armature while in flight toward the stop position;

stabilizing, based on the retarding of the armature, closing of the injection control valve to end the injection of fuel;

limiting bouncing the armature against an armature stop based on the retarding of the armature; and the stabilizing of the closing of the injection control valve includes stabilizing the injection control valve between a valve rod unattached to the injection control valve and a valve seat, based on the limiting of the bouncing of the armature;

monitoring a back EMF induced by the armature in an actuator control circuit; and varying at least one of a dwell time before reenergizing the solenoid or a duration of reenergizing the solenoid based on a timing of a local maximum of the back EMF that is indicative of the armature reaching the stop position.

15. The method of claim 14 wherein the reenergizing of the solenoid actuator includes reenergizing the solenoid actuator with an armature retarding current that is based on an expected closing timing of the injection control valve.

16. The method of claim 15 further comprising electronically trimming the fuel injector with the armature retarding current.

17. The method of claim 16 wherein electronically trimming the fuel injector includes varying at least one of a duration of the armature retarding current or a dwell time between the armature retarding current and a hold current, relative to a preceding armature current in a preceding engine cycle.

18. The method of claim 14 wherein the stabilizing of the closing of the injection control valve includes limiting bouncing the injection control valve between the valve rod and the valve seat based on the limiting of the bouncing of the armature.

* * * * *